US006039458A

United States Patent [19]

Coates, Jr. et al.

[11] Patent Number: 6,039,458

[45] Date of Patent: Mar. 21, 2000

[54] SEGMENTED LIGHT SYSTEM AND METHODS OF USING

[76] Inventors: Wayne L. Coates, Jr.; David M. Fisher, Jr., both of 1 Riverfront Plz., Suite 650, North Little Rock, Ark. 72114

[21] Appl. No.: 09/178,041

[22] Filed: Oct. 23, 1998

[51] Int. Cl.[7] ..... F21V 15/00

[52] U.S. Cl. ..... 362/249; 362/250; 362/251; 362/252

[58] Field of Search ..... 362/249, 250, 362/251, 252

[56] References Cited

U.S. PATENT DOCUMENTS 4,271,458 6/1981 George, Jr. ..... 362/236

4,521,839 6/1985 Cook et al. ..... 362/238

5,410,458 4/1995 Bell ..... 362/219

*Primary Examiner*—Cassandra Spyrou

*Assistant Examiner*—Mohammad Y. Sikder

*Attorney, Agent, or Firm*—Joe D. Calhoun

[57] ABSTRACT

Systems for housing and supporting, then either deploying or storing, light strings comprising stringing a light within a connectible series of hollow rigid or semi-rigid sub-sleeves that are essentially transparent or translucent, said sub-sleeves having sufficient rigidity to support and protect said light string when attached at points to a support structure while having sufficient flexibility to permit cornering and angular positioning as desired.

15 Claims, 1 Drawing Sheet

SEGMENTED LIGHT SYSTEM AND METHODS OF USING

STATEMENT REGARDING FEDERALLY SPONSORED RESEARCH OR DEVELOPMENT

Not Applicable.

BACKGROUND OF THE INVENTION

The invention described herein generally relates to devices and systems for housing, supporting, deploying and storing strings of lights. Over the years, there have been many patents issued for various features of inventions pertaining to lighting systems, especially those used for decorative or ornamental purposes. Examples of some features include: longitudinal flexibility or rigidity; open or openable systems versus enclosed or encapsulated systems; lighting support versus decoration; and configuration of light(s). A search of patents has revealed that inventors have recognized various problems concerning the above-identified features, and have proposed various devices or systems to overcome at least some aspects thereof.

The invention described herein primarily deals with problems associated with the difficulties associated with deploying or storing lighting, especially strings of "Christmas lights" commonly deployed outdoors. Such problems include those associated with having deployment mechanisms that are sufficiently rigid and supportive to allow deployment without numerous attachments to the mounting structure, or without unwanted draping and tangling of the light string. Other problems include those associated with providing a rigid or semi-rigid deployment system having sufficient longitudinal flexibility to allow cornering when desired. The invention described herein is also directed to problems associated with storing such light systems; such problems include those associated with providing a deployment mechanism that allows quick and easy removal of the lights from the mounting structure, in a manner preventing tangling of the light string and facilitating compaction of the string into subunits of the desired length. See, for example, U.S. Pat. No. 5,469,344 issued to Kotsakis on Nov. 21, 1995.

Other patents have been directed at problems associated with the maintenance of the light string, such as providing access to replace light bulbs situated (at least partly) within the invention. Patents which arguably address these concerns include the following:

| U.S. Pat. No. | Inventor(s) | Date |
|---|---|---|
| 4,885,664 | Hermanson | 12-5-89 |
| 3,404,268 | Fowler | 12-23-68 |
| 5,410,458 | Bell | 4-25-95 |

Other patents have been directed to providing longitudinal lighting systems that can assume a variety of configurations. Many of these are for systems that are segmented or modular, and usually closed systems. Patents which arguably address these concerns include:

| U.S. Pat. No. | Inventor(s) | Date |
|---|---|---|
| 5,057,981 | Bowen et al. | 10-15-91 |
| 4,581,687 | Nakanishi | 4-8-86 |
| 4,521,839 | Cook et al. | 6-4-85 |

Other patents of general interest to the examiner might include the following:

| U.S. Pat. No. | Inventor(s) | Date |
|---|---|---|
| 4,107,767 | Anquetin | 8-15-78 |
| 4,271,458 | George | 6-2-81 |

A study of known patents indicates that, while inventors have provided specific devices or systems which solve some aspects of the problems associated with the housing, support, deployment and storing of lighting systems, no solutions have been discovered that address all of such problems. The patents known in the art lack one or more essential features of the invention disclosed herein.

SUMMARY OF THE INVENTION

In general, this application pertains to systems for housing and supporting, then either deploying or storing, light strings. The system comprises a string of lights within a connectible series of hollow rigid or semi-rigid sub-sleeves that are essentially transparent or translucent, said sub-sleeves having sufficient rigidity to support the light string with minimal mounting connections to a mounting structure, and to protect said light string from weather or jarring; the support structure also has sufficient flexibility to permit cornering and angular positioning of the light string as desired. Ideally, the system will also permit convenient access to an interior cavity to allow replacement of non-operational bulbs or other maintenance activities on the light string.

One primary object of the invention disclosed herein is to provide a system for housing and supporting a linear string of lights. Another primary object of the invention is to provide a housing and support system that is easy to deploy and easy to disassemble. Another object of the invention disclosed herein is to provide a lighting system that provides both deployment support and sufficient flexibility for use in a variety of configurations often encountered, such as (for example) along the eaves or similar areas of buildings. Another object of the invention is to provide a lighting system that is relatively inexpensive and easy to manufacture. Another object of the present invention is to provide a lighting system that is easily maintained. Another object of the present invention is to provide a lighting system that stores easily, without the tangling of wires usually associated with strings of Christmas lights. Other objects of the invention will be apparent within the context of the over all application.

BRIEF DESCRIPTION OF DRAWINGS

The following describes the drawings accompanying this application, which are incorporated herein.

Figures 1, 2, 3, 4, 5:
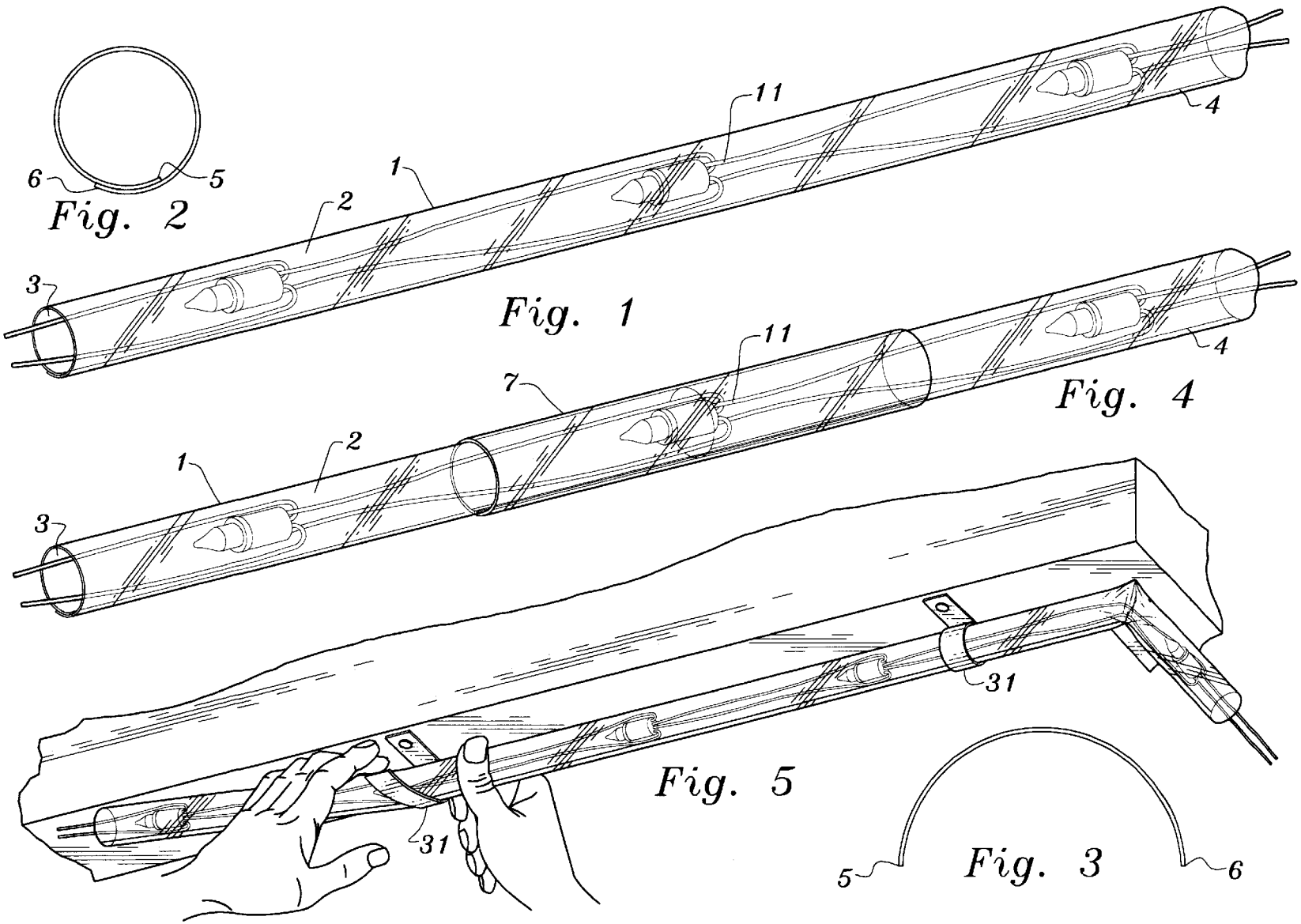
FIG. 1 depicts a side perspective view of a sub-sleeve (1) of one embodiment of the invention, including its respective linear subsection of the light string (11). Also included are the interior cavity (2), an open end (3) of the sub-sleeve, and a slit (4) down the length of the sub-sleeve.
FIG. 2 depicts a cross-sectional view of one version of a sub-sleeve, in a resting position, without its respective linear subsection of the light string. Included are a first marginal edge (5) and a second marginal edge (6).
FIG. 3 depicts a cross-sectional view of one version of the invention, in a parted position, without its respective linear subsection of the light string.
FIG. 4 depicts a side perspective view of one version of the invention, including a partial view of two aligned sub-sleeves (without their respective linear subsections of the light string) having ends aligned together at a juncture (abutting each other, encircling the middle light bulb), and a collar joint (7) spanning their intermediate separation point and essentially connecting the juncture of the sub-sleeves. Also included is a slit (4) down the length of the sub-sleeve.
FIG. 5 depicts a pictorial view of one version of the invention captured within a bracket, or being captured by a bracket (hand opening capture end) mounted on the eaves of a building.

These drawings illustrate certain details of certain embodiments; the invention disclosed herein is not limited to only the embodiments so illustrated. The invention disclosed herein may have equally effective or legally equivalent embodiments.

DETAILED DESCRIPTION OF THE INVENTION

For the sake of simplicity and to give the claims of this patent application the broadest interpretation and construction possible, the following definitions will apply:

1. Collar means an encircling device of structure used to restrain or limit the movement of that which is encircled; for example, two adjacent ends of aligned sub-sleeves can be encircled by a shorter segment of the same sub-sleeve material, essentially forming a collar joint.

2. Cooperating engagement means to align functionally, to enable the operation of the elements so engaged; for example, abutting ends of aligned sub-sleeves may be cooperatively engaged by any means maintaining both ends in a position to facilitate the operation of both respective subsleeves, such as (for example) a collar joint arrangement or any other arrangement (male-female ends, screw threading, harnessing, adhesion) limiting the undesired movement or positioning of the aligned sub-sleeves.

3. Juncture means the abutment of two adjacent ends of aligned sub-sleeves, whether or not joining (by collar joint or otherwise) has occurred.

4. Light permeable means transparent, translucent, or any material capable of allowing some quantum of light rays to pass through.

5. Overlap means essentially to extend past or along in close proximity, creating an area in common with whatever is being extended past or along; as an example, when a tube is slit down its length, the slit creates two marginal edges separated by the slit, and those marginal edges may slide past each other (one on top of the other) and essentially form an overlapping seam.

6. Polymeric means comprised of or pertaining to a polymer, expecially those compounds or materials that have sufficient resiliency to enable the memory functions in this invention, such as polycarbonate materials; for example, the sleeve described as resiliently rigid may be made of any polymeric material enabling the sleeve to be urged apart and later return to its original resting position. Some such material are expressly identified herein, but the resilient elements of the invention may additionally be constructed, in whole or in relevant part, of similar materials that are either not named herein or not yet invented.

7. Resilient means the ability of a material to enable it to resume its original shape or postion after being urged away from that original position; for example many polymeric materials, especially polycarbonate materials, are endowed with an elasticity enabling it to be bent away from an original resting position and, upon cessation of the bending force, to return to that resting position; this property is sometimes referred to as memory.

Also for the sake of simplicity, the conjunctive "and" may also be taken to include the disconjunctive "or," and vice versa, whenever necessary to give the claims of this patent application the broadest interpretation and construction possible. Likewise, when the plural form is used it may be taken to include the singular form and vice versa.

The invention disclosed herein is not limited by construction materials to the extent that such materials satisfy the structural or functional requirements; for example, any materials may be used to make a sub-sleeve so long as the materials fulfill the requirements that said sub-sleeve be, for example, light permeable, sufficiently rigid or semi-rigid to support the light string, and sufficiently resilient to be capable of resuming a resting position after released from an urged apart position.

In its most general form, the invention includes a lighting system comprising at least one string of electrically circuited light bulb sockets having bulbs, and a plurality of resiliently-rigid light-permeable sub-sleeves. Each of said sub-sleeves (1) defines an essentially linear interior cavity (2), and has two opposite open ends (3); each end is adapted for cooperating engagement with an end of another of said sub-sleeves aligned therewith. Down the length of each of said sub-sleeves is a slit (4) along a longitudinal axis, said slit cleaving said sub-sleeve along a first marginal edge (5) both adjacent to and on one side of said slit and a second marginal edge (6) both adjacent to and on the other side of said slit; each slit essentially separates the previously continuous cavity wall along the slit, with the respective strip of wall running longitudinally adjacent each side of the slit labeled a marginal edge. Each marginal edge may overlap or extend past the other marginal edge, the amount of overlap essentially forming a seam down the length of the sub-sleeve sufficient to essentially maintain the continuity of said cavity housing; whereas the cavity wall was continuous before the sub-sleeve was slit (except for the open ends), the slit creates a temporary longitudinal opening that (due to the sub-sleeve resilience and the memory of its enveloping configuration) essentially closes due to the overlapping of the longitudinal marginal edges adjacent the slit. Such a cavity may then be temporarily opened (along the slit) for the depositing therein of a respective subsection of the light string (11); the cavity may also be temporarily opened at selected points to replace nonfunctional light bulbs or to perform other maintenance on the system. The system of sub-sleeves essentially house the respective linear subsections of the light string, provide protection from inclement weather conditions, and support them while the light system is deployed. When the system is to be stored, the sub-sleeves likewise provide housing, protection and support.

Said sub-sleeves may be selected from the group consisting of translucent and transparent materials, and combinations thereof Any light permeable materials may be used. Additionally, said sub-sleeves may be selected from the group consisting of clear and pigmented materials, and combinations thereof. As an example, the sub-sleeves may be made of translucent orange material for use during Halloween; for Christmas, some sub-sleeves may be made of red transparent material while other sleeves may be made of green translucent material, or other combinations or permutations of pigmentation and light permeability. In one particular version of the invention, said sub-sleeves are constructed of polymeric materials. The sub-sleeves may be polycarbonate material such as (for example) plastic, nylon, polyvinyl chloride, polyurethane, polyetheline or saran, or combinations thereof One embodiment includes a light system as described above, wherein a plurality of pairs of said sub-sleeve open ends are aligned in cooperative engagement, each sub-sleeve essentially housing and supporting a respective linear subsection of said light string. Although any means of cooperatively engaging the aligned ends of two sub-sleeves will suffice, one preferred means may include at least one shorter segment of said slitted sub-sleeve material snugly collaring both ends of adjacent sub-sleeves for joinder as a collar joint (7). Since this version of the collar joint is made of the same material (having the same beginning diameter and wall thickness) as the sub-sleeve, the collar joint will essentially snugly envelope the underlying sub-sleeve when the collar joint returns to its resting position after having been urged apart along its slit when it is being deployed around the sub-sleeve. Although the collar joint may be urged to slide up or down along its underlying sub-sleeve, the tendency of the collar joint to return to its resting position (having the same diameter as the sub-sleeve) essentially causes its interior surface to maintain frictional contact with the outer surface of the underlying sub-sleeve; this version of the collar joint may therefore maintain its positioning spanning a juncture of aligned sub-sleeve ends after the collar joint has been urged into place. Alternatively, materials such as tape or other means may be used either on the outer surface along the overlapping marginal edges or the interior surface of the collar joint to prevent the collar joint from being urged apart toward an open position after it has been deployed around a sub-sleeve.

The invention described herein is capable of housing, supporting and deploying an essentially linear string of lights in a variety of configurations. Uncollared joints allow folding at the separation point therebetween, for cornering or angular positioning; such configurations may also be accomplished at virtually any point along the sleeve by pinching a sub-sleeve and then folding the sub-sleeve at the pinch point. Accordingly, one version of the invention includes a light system as described herein, wherein at least one pair of said sub-sleeve open ends are aligned in cooperative engagement with each sub-sleeve essentially housing and supporting a respective linear subsection of said light string. There is also at least one other pair of said sub-sleeve open ends aligned in cooperative engagement with each sub-sleeve essentially housing and supporting another respective linear subsection of said light string. Said respective pairs of said cooperatively engaged sub-sleeves are separated from at least one other respective pair of cooperatively engaged sub-sleeves by a point along said light string at an uncollared juncture, said separation point enabling said light system to assume angular positioning by folding at the separation point.

The linear length of said sleeve may also be shortened by folding, at at least one of said separation points; at least one of said sub-sleeves may be folded onto an adjacent sleeve portion on the opposite side of said separation point, until said said sub-sleeve is essentially parallel and adjacent to said adjacent sleeve portion. On the other hand, often it is advantageous for the light system to be deployed in a purely linear configuration. In this instance, all of said sub-sleeves are aligned in cooperative engagement, forming a continuous linear sleeve essentially housing and supporting essentially all linear subsections of said light string.

One particular version of the invention includes a light system as described above, wherein each of said aligned sub-sleeves is essentially tubular, and having an open-slit parted position after said marginal edges are urged apart for accessing the interior of said sub-sleeve. One method of urging said marginal edges apart is to insert an elongate pointed probe tool into one of the open ends of the tube, and out through the slit, thereby parting the marginal edges, then progressively running the probe along the slit along the remaining length of the tube. The tubular sub-sleeve also has an essentially closed-slit resting position with said first marginal edge overlapping said second marginal edge along said slit in said resting position, said sub-sleeves having sufficient resilience to resume said resting position after said parted position. Depending upon the thickness of the tube wall and the tensil characteristics of the tube materials, the tube should naturally assume the resting quasi-closed position after the slitting, with the marginal edges overlapping in close enough proximity to each other so that the sub-sleeve essentially appears to be a tube having a continuous wall. It is important that the marginal edges overlap an optimal amount, sufficient only for facilitating the quasi-closed resting position, without encroaching upon the interior cavity and interfering with the depositing or positioning of the light string therein.

The system may further include means for attaching a sub-sleeve to the mounting structure(s). Although any attachment means satisfying the functional requirements are sufficient, said attachment means may be a plurality of means selected from the group consisting of J-brackets, C-brackets, wire harnesses and combinations thereof In one embodiment of the invention, said attachment means are a plurality of brackets (31), each having a securing end and a resilient capturing end, said securing end having sufficient rigidity to enable firm securing to the mounting structure; said capturing end has a resting position enabling substantial encircling of a sub-segment of a sub-sleeve, and has sufficient resilience to enable said capturing end to resume said resting position after said capturing end has been urged outwardly from said resting position enabling said encircling of said sub-sleeve.

A preferred embodiment of the invention is a lighting system comprised of at least one string of electrically circuited light bulb sockets having bulbs, and a plurality of essentially rigid tubular polycarbonate sub-sleeves. Each of said sub-sleeves defines an essentially cylindrical interior cavity in the range of approximately ¼ inch to approximately 1½ inch in diameter in a resting position (preferably approximately ½ inch in diameter), and essentially housing and supporting a respective linear subsection of said light string; each also has two opposite open ends, each end adapted for cooperating engagement with an end of another of said sub-sleeves aligned therewith. Each of said sub-sleeves is comprised of a wall in the range of approximately 0.005 inch thick to approximately 0.025 inch thick (preferably approximately 0.015 inch thick), in the range of approximately 18 inches long to approximately 48 inches long (preferably approximately 36 inches long), and light permeable. Down the length of each is a slit along a longitudinal axis, said slit cleaving said sub-sleeve and leaving a first marginal edge both adjacent to and on one side of said slit; said slit also leaves a second marginal edge both adjacent to and on the other side of said slit. Each sub-sleeve has an open-slit parted position, after said marginal edges are urged apart, for accessing the interior of said sub-sleeve; each also has an essentially closed-slit resting position, with said first marginal edge overlapping said second marginal edge in the range of approximately ¼ inch wide to approximately 1½ inch wide (preferably approximately ½ inch wide). Said sub-sleeves have sufficient resilience to resume said resting position after said urged parting. This preferred system includes, for each pair of aligned sub-sleeves, a segment of said tubular sub-sleeve approximately 8 inches long snugly collaring both ends of said adjacent sub-sleeves for said cooperative engagement as a collar joint. Said light system may further comprise a plurality of brackets for mounting said sub-sleeves on the mounting structure(s), each of said brackets having a securing end and a resilient capturing end; said securing end has sufficient rigidity enabling firm securing to the mounting structure, whereas said capturing end has a resting position enabling substantial encircling of a sub-section of a sub-sleeve and having sufficient resilience enabling said capturing end to resume said resting position after said capturing end has been urged outwardly from said resting position enabling said encircling of said sub-sleeve. Said bracket may essentially be a substantially closed-ended curl constructed of polymeric material.

The invention disclosed herein also includes a method of making a light system described herein. Such method includes the step of parting each such slit a sufficient amount to allow threading, insertion or other depositing of said light string within. Said sub-sleeves have a sufficient cumulative length for housing essentially all of said bulbs of said light string. Another step of this method includes threading, inserting or otherwise depositing a respective linear subsection of said light string within a respective sub-sleeve. Although such depositing may include the positioning of multiple lengths or subsections of the light string within a single sub-sleeve, a preferred embodiment is the positioning of virtually the same length of the light string as the length of the sub-sleeve.

More particularly, the invention may include a method of making a light system described above, comprising the following steps. Starting at one open end of a first sub-sleeve, progressively parting said slit (from said starting end towards a terminal end) and threading a terminal linear subsection of said light string the length of said interior cavity of said first sub-sleeve, said slit parting and light string threading also culminating in the stationing (outside the entrance to the terminal open end of said first sub-sleeve) of an end of said light string adapted to access a source of electricity for illumination of said light string. The slit of said collar joint may likewise be parted, permitting the sliding of said collar joint over said sub-sleeve; the marginal edges are secured sufficient to prevent subsequent parting of said collar joint slit. For each successive sub-sleeve, parting said slit and progressively depositing a respective linear subsection of said light string along said interior cavity of the respective sub-sleeve. At each juncture of two sub-sleeves, parting a collar joint slit, sliding said collar joint over said juncture of said sub-sleeves, and securing said marginal edges in said resting position sufficient to prevent subsequent parting of said collar joint slit.

The invented method may also include a method of deploying an above described light system on one or more mounting structures. Such method includes performing the following steps. At desired positions along the mounting structure (s), securing means for attaching said light system to the mounting structure. Slide a collar joint over a juncture of two aligned sub-sleeves, repeating with other respective collar joints at other junctures to achieve the dimensions desired. Then attach said light system to said attachment means secured to the mounting structure.

Alternatively, said method comprises the following steps: (a) at desired positions along the mounting structure(s), secure means for attaching said light system to the mounting structure(s); (b) slide a collar joint over a juncture of two aligned sub-sleeves.; (c) attach said jointed sub-sleeves to said attachment means secured to the mounting structure(s). Repeat steps (b) and (c) as desired. Where an angle is desired, pinch a sub-sleeve at the desired point of angular divergence, then fold said sub-sleeve at said pinch point.

The invented method also includes a method of storing a light system described above, comprising the steps of: detaching said sub-sleeves from said attachment means secured to the mounting structure; at sub-sleeve lengths desired for storing, sliding said joint collars away from said sub-sleeve junctures; and folding said sleeve at the separation point at each of said junctures.

Those skilled in the art who have the benefit of this disclosure will appreciate that it may be used as the creative basis for designing devices or methods similar to those disclosed herein, or to design improvements to the invention disclosed herein; such new or improved creations should be recognized as dependant upon the invention disclosed herein, to the extent of such reliance upon this disclosure.

We claim:

1. A lighting system, comprised of:

at least one string of electrically circuited light bulb sockets having bulbs, and a plurality of resiliently-rigid light-permeable sub-sleeves, each defining an essentially linear interior cavity and having two opposing open ends, said cavity essentially housing and supporting a respective linear subsection of said light string, each end adapted for cooperating engagement with an end of another of said sub-sleeves aligned therewith, each of said sub-sleeves being cleaved along a longitudinal axis, said cleavage essentially forming a slit along said sub-sleeve thereby essentially creating a first marginal edge both adjacent to and on one side of said slit and a second marginal edge both adjacent to and on the other side of said slit, said sub-sleeves having an essentially closed-slit resting position with said first marginal edge overlapping said second marginal edge along said slit in said resting position.

2. A light system as described in claim 1 above, wherein said sub-sleeves are selected from the group consisting of translucent and transparent materials, and combinations thereof.

3. A light system as described in claim 1 above, wherein said sub-sleeves are selected from the group consisting of clear and pigmented materials, and combinations thereof.

4. A light system as described in claim 1 above, wherein said sub-sleeves are constructed of polycarbonate materials.

5. A light system as described in claim 1 above, wherein a plurality of pairs of said sub-sleeve open ends are aligned in cooperative engagement, each sub-sleeve essentially housing and supporting a respective linear subsection of said light string.

6. A light system as described in claim 5 above, further including (as a means of said cooperative engagement) at least one shorter segment of said sub-sleeve material snugly collaring both ends of adjacent sub-sleeves for joinder as a collar joint.

7. A light system as described in claim 5 above, wherein at least one pair of said sub-sleeve open ends are aligned in cooperative engagement with each sub-sleeve essentially housing and supporting a respective linear subsection of said light string, and at least one other pair of said sub-sleeve open ends are aligned in cooperative engagement with each sub-sleeve essentially housing and supporting another respective linear subsection of said light string, said respective pairs of said cooperatively engaged sub-sleeves separated from at least one other respective pair of cooperatively engaged sub-sleeves by a point along said light string at an uncollared juncture, said separation point enabling said light system to assume angular positioning.

8. A light system as described in claim 7 above, wherein the linear length of said sleeve may be shortened by folding, at at least one separation point, at least one of said sub-sleeves onto an adjacent sleeve portion opposite said separation point, until said said sub-sleeve is essentially parallel and adjacent to said adjacent sleeve portion.

9. A light system as described in claim 5 above, wherein all of said sub-sleeves are aligned in cooperative engagement, forming a continuous linear sleeve essentially housing and supporting essentially all linear subsections of said light string.

10. A light system as described in claim 1 above, wherein each of said aligned sub-sleeves is essentially tubular, having an open-slit parted position after said marginal edges are urged apart for accessing the interior of said sub-sleeve, and having an essentially closed-slit resting position with said first marginal edge overlapping said second marginal edge along said slit in said resting position, said sub-sleeves having sufficient resilience to resume said resting position after said parted position.

11. A light system as described in claim 1 above, further comprising means for attaching a sub-sleeve to the mounting structure(s).

12. A light system as described in claim 1 above, wherein said attachment means are a plurality of means selected from the group consisting of J-brackets, C-brackets, wire harnesses and combinations thereof.

13. A light system as described in claim 1 above, wherein said attachment means are a plurality of brackets, each having a securing end and a resilient capturing end, said securing end having sufficient rigidity to enable firm securing to the mounting structure, said capturing end having a resting position enabling substantial encircling of a sub-segment of a sub-sleeve and having sufficient resilience to enable said capturing end to resume said resting position after said capturing end has been urged outwardly from said resting position enabling said encircling of said sub-sleeve.

14. A lighting system, comprised of:

at least one string of electrically circuited light bulb sockets having bulbs, and a plurality of resiliently rigid tubular polycarbonate sub-sleeves, each defining an essentially cylindrical interior cavity in the range of approximately ¼ inch to approximately 1½ inch in diameter in a resting position and essentially housing and supporting a respective linear subsection of said light string and having two opposing open ends, each end adapted for cooperating engagement with an end of another of said sub-sleeves aligned therewith, each of said sub-sleeves comprising a wall in the range of approximately 0.005 inch to approximately 0.025 inch thick, in the range of approximately 18 inches long to 48 inches long, and light permeable and having a slit along a longitudinal axis, said slit cleaving said sub-sleeve and leaving a first marginal edge both adjacent to and on one side of said slit and leaving a second marginal edge both adjacent to and on the other side of said slit, each sub-sleeve having an open-slit parted position after said marginal edges are urged apart for accessing the interior of said sub-sleeve, and having an essentially closed-slit resting position with said first marginal edge overlapping said second marginal edge in the range of approximately ¼ inch to approximately 1½ inch, said sub-sleeves having sufficient resilience to resume said resting position after said urged parting, for each pair of aligned sub-sleeves, a segment of said tubular sub-sleeve in the range of approximately 4 inches long to approximately 12 inches long, snugly collaring both ends of said adjacent sub-sleeves for said cooperative engagement as a collar joint;

said light system further comprising a plurality of brackets for mounting said sub-sleeves on the mounting structure(s), each of said brackets having a securing end and a resilient capturing end, said securing end having sufficient rigidity enabling firm securing to the mounting structure, said capturing end having a resting position enabling substantial encircling of a sub-section of a sub-sleeve and having sufficient resilience enabling said capturing end to resume said resting position after said capturing end has been urged outwardly from said resting position enabling said encircling of said sub-sleeve.

15. A lighting system, comprised of:

at least one string of electrically circuited light bulb sockets having bulbs, and a plurality of resiliently rigid tubular polycarbonate sub-sleeves, each defining an essentially cylindrical interior cavity approximately ½ inch in diameter in a resting position and essentially housing and supporting a respective linear subsection of said light string and having two opposing open ends, each end adapted for cooperating engagement with an end of another of said sub-sleeves aligned therewith, each of said sub-sleeves comprised of a wall approximately 0.015 inch thick, approximately 36 inches long, and light permeable and having a slit along a longitudinal axis, said slit cleaving said sub-sleeve and leaving a first marginal edge both adjacent to and on one side of said slit and leaving a second marginal edge both adjacent to and on the other side of said slit, each sub-sleeve having an open-slit parted position after said marginal edges are urged apart for accessing the interior of said sub-sleeve, and having an essentially closed-slit resting position with said first marginal edge overlapping said second marginal edge approximately ½ inch, said sub-sleeves having sufficient resilience to resume said resting position after said urged parting, for each pair of aligned sub-sleeves, a segment of said tubular sub-sleeve approximately 8 inches long snugly collaring both ends of said adjacent sub-sleeves for said cooperative engagement as a collar joint;

said light system further comprising a plurality of brackets for mounting said sub-sleeves on the mounting structure(s), each of said brackets having a securing end and a resilient capturing end, said securing end having sufficient rigidity enabling firm securing to the mounting structure, said capturing end having a resting position enabling substantial encircling of a sub-section of a sub-sleeve and having sufficient resilience enabling said capturing end to resume said resting position after said capturing end has been urged outwardly from said resting position enabling said encircling of said sub-sleeve.

* * * * *